United States Patent [19]

Wahnschaff

[11] 4,119,057

[45] Oct. 10, 1978

[54] GLUE APPLICATOR ROLL ASSEMBLY

[76] Inventor: Paul Wahnschaff, 3202 Marjan Dr., Atlanta, Ga. 30340

[21] Appl. No.: 832,657

[22] Filed: Sep. 12, 1977

[51] Int. Cl.[2] ..... B05C 1/02; B05C 13/00

[52] U.S. Cl. ..... 118/203; 101/363; 118/245

[58] Field of Search ..... 118/203, 245, 104; 100/174; 271/174; 101/363

[56] References Cited

U.S. PATENT DOCUMENTS

| | | | |
|---|---|---|---|
| 1,143,385 | 6/1915 | Haberle et al. | 118/203 |
| 1,804,365 | 5/1931 | Price | 118/245 |
| 1,818,198 | 8/1931 | Davis | 118/245 X |
| 2,053,730 | 9/1936 | Minkow | 118/245 |
| 2,303,171 | 11/1942 | Morrison | 118/203 |

*Primary Examiner*—John P. McIntosh
*Attorney, Agent, or Firm*—Jones, Thomas & Askew

[57] ABSTRACT

Wiper blades are mounted on the end bearing blocks and are located at each end of a rotatable cylindrical glue applicator roll and are arranged to wipe the glue from the flat ends of the applicator roll and from the end portions of the annular surface of the applicator roll. The wiper blades include a horizontal leg having a concave roll contact surface normally in engagement with the end curved portion of the cylindrical roll and a flat surface in contact with the flat end of the roll. A portion of the wiper blade adjacent the flat end of the roll is angled between a tangent and a radius from the axis of rotation of the roll on the downward moving side of the roll and includes a groove for deflecting and guiding the glue in a downward direction off the flat end of the roll. A pick finger support bar extends above and parallel to the cylindrical roll, a plurality of pick fingers are mounted on the pick bar, and the pick bar is adjustably supported at its ends substantially without any bending forces being applied to the pick bar so as to permit the pick bar to remain rectilinear and to properly position the pick fingers against the cylindrical glue applicator roll.

5 Claims, 3 Drawing Figures

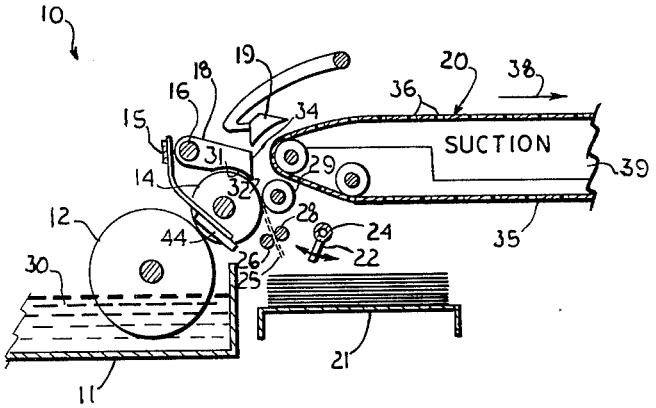
Fig. 1
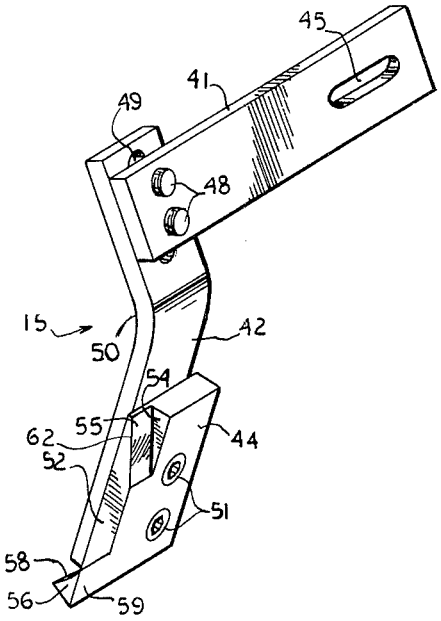
Fig. 3
Fig. 2
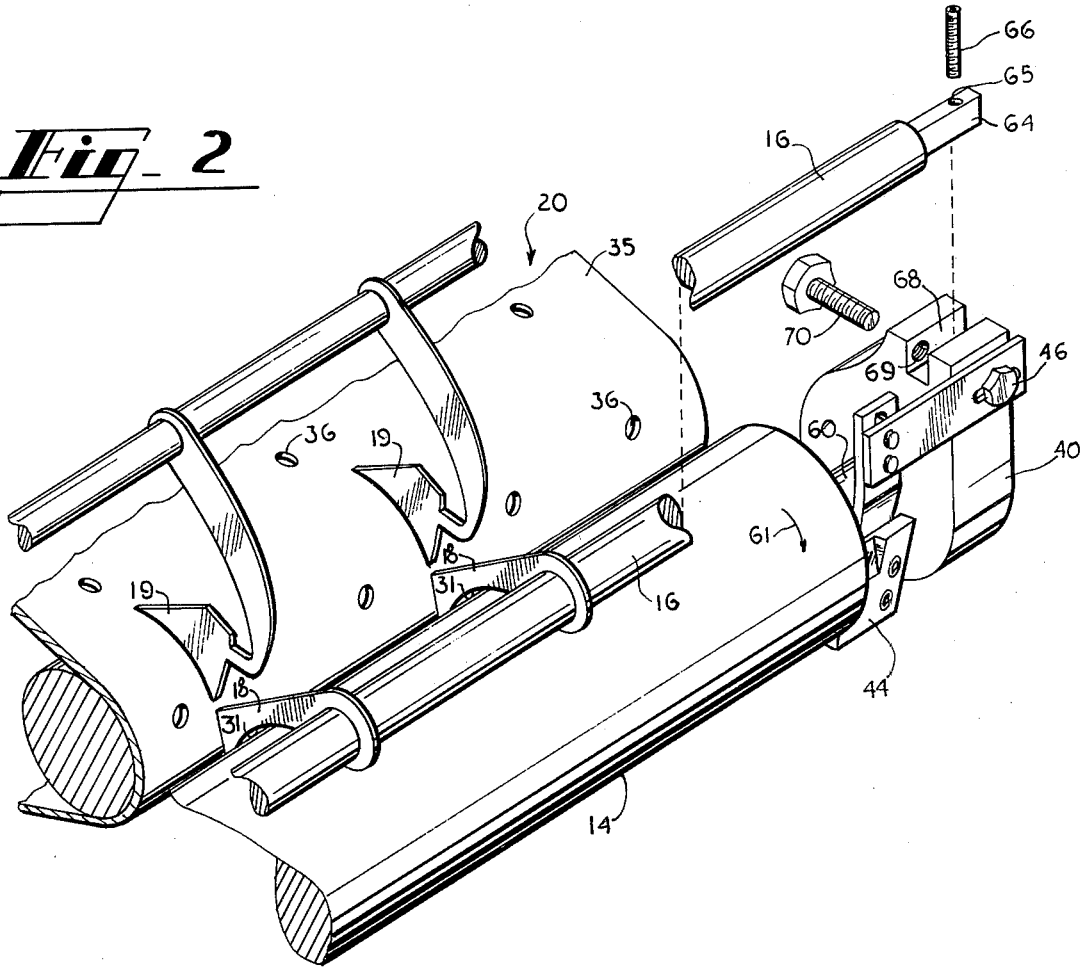

GLUE APPLICATOR ROLL ASSEMBLY

BACKGROUND OF THE INVENTION

This invention relates to glue applicator assemblies of the type used to apply liquid glue to sheet material, such as to blanks which are ultimately formed into paper boxes. More particularly, the invention relates to a glue applicator roll assembly for a gluer.

Various prior art glue applicator equipment has been developed for the purpose of feeding sheets of material in sequence to a series of processing stations and coating the sheet material with glue and other liquids at one of the processing stations. These machines typically include equipment for picking off the end sheet from a stack of sheet material, feeding the sheet along a path generally parallel to the plane of the sheet material past a rotating cylindrical glue applicator roll, and then to various subsequent work stations. The glue applicator roll usually continuously rotates in contact with another wetting roll which is partially submerged in a body of liquid glue or other liquid. As the system operates, the liquid glue tends to accumulate and harden on the various parts of the processing equipment, particularly on the end portions of the glue applicator roll. The accumulation of glue at the ends of the glue applicator roll is undesirable, particularly because an accumulation of glue tends to interfere with the proper continuous operation of the equipment.

Various wiper blades and other devices have been used in the past to scrape or wipe glue from the cylindrical glue applicator roll. The typical prior art wiper blades have been positioned at the ends of the glue applicator roll by mounting the wiper blades on the pick finger support bar which is usually located above the cylindrical applicator roll and which is in a convenient location for mounting the wiper blades or by supporting the wiper blades form the bearing blocks at the ends of the glue applicator roll. The pick finger support bar supports a plurality of pick fingers which are arranged across the length of the glue applicator roll and which function to wedge the sheet material away from the glue applicator roll and guide the sheet material along its processing path toward the next work station. It is important that the pick fingers have their pointed ends in close juxtaposition with respect to the curved surface of the cylindrical glue applicator roll so as to properly pick the sheet material away from the roll instead of allowing the sheet material to pass between the pick fingers and the glue applicator roll. Any vibrations or other external forces imparted to the pick support bar tends to disrupt the positions of the pick fingers, causing the pick fingers to allow the sheet material moving with the cylindrical glue applicator roll to pass beneath the pick fingers and therefore jam the equipment.

The prior art pick finger support bars have been supported at their ends adjacent and parallel to the cylindrical glue applicator roll. The prior art structure used to support the pick finger support bar tends to cause the pick finger support bar to bow or bend downwardly at its center portion. The amount of curvature in the bow varies, depending upon the force applied at the ends of the pick finger support bar. For example, one prior art structure comprises slots formed in the end bearing blocks of the equipment, and internally threaded bore extending through each end of the pick finger support bar, and elevational screws threaded through the bores for engagement with the bottom of the slots. The machine operator is able to adjust the height of the ends of the pick finger support bar by rotating the elevation screws to raise or lower the ends of the bar. After the ends of the bar have been properly located, the prior art assembly included a means for clamping the end portions of the middle portion of the bar downwardly into the slots to hold the bar at its ends. This downward clamping force tends to bow the bar downwardly, with more force at the ends causing a larger bend in the bar. The pick fingers supported intermediate the ends of the pick finger support bar are arranged so as to be properly positioned when the pick finger support bar is properly elevated at its ends, and when there is no curvature in the bar. When the bar is bowed downwardly with the clamping action of the prior art assemblies, the pick fingers at the middle portion of the pick finger support bar are supported at an elevation lower than those pick fingers nearer the ends of the bar. The machine operator is therefore required to adjust the pick finger support bar, by loosening the clamps somewhat, or by raising the ends of the bar so that the middle pick fingers better fit about the cylindrical glue applicator roll. Loosening of the support tends to cause the pick finger support bar to be less stable, and readjusting the elevation of the ends of the support bar to properly position the middle pick fingers tends to cause the pick fingers nearer the ends of the support bar to be moved slightly out of their proper positions. In either instance, there is at least some likelihood that the equipment will malfunction.

SUMMARY OF THE INVENTION

Briefly described, the present invention comprises a glue applicator roll assembly for a gluer which has improved end roll wiper structure and improved pick finger support means. Wiper blades are mounted at opposite ends of the cylindrical glue applicator roll and are shaped and supported so as to wipe the flat end surfaces of the roll as well as a small area of the curved end portion of the roll, thereby causing the glue to be effectively removed from the areas of the cylindrical applicator roll where the glue tends to accumulate. The wiper blade is supported from the bearing blocks at the ends of the cylindrical glue applicator roll and any vibrations or forces received from the wiper blade are transmitted to the end bearing blocks. The pick finger support bar of the assembly is mounted at each of its ends in slots of the bearing blocks, with the clamping mechanism which holds the ends of the pick finger support bar applying its clamp forces in a horizontal direction against the end of the bar, with the opposite flat surface of the bar being urged against a complimentary flat surface in the slot of the end bearing block. This arrangement tends to urge the rectilinear pick finger support bar to remain in its rectilinear configuration, even though an elevation screw can be utilized to modify the elevation of the end of the pick finger support bar.

Thus, it is an object of this invention to provide an improved glue applicator roll assembly for use in a gluer and the like in which the cylindrical glue applicator roll is wiped clean of glue at its opposite ends, in which the wiper blades do not transmit vibrations or other forces to the pick finger support bar, and in which the pick finger support bar is maintained in a substantially rectilinear configuration.

Another object of this invention is to provide a glue applicator roll assembly which is inexpensive to manufacture and repair, which is expedient to adjust, and which is reliable in operation.

Other objects, features and advantages of this invention will become apparent upon reading the following specification, when taken in conjunction with the accompanying drawings.

BRIEF DESCRIPTION OF THE DRAWINGS

FIG. 1 is a schematic side elevational view of a portion of apparatus for applying glue to sheet material, showing the improved glue applicator roll assembly.

FIG. 2 is a partial perspective view, with parts shown in expanded positions, of the improved glue applicator roll assembly.

FIG. 3 is a perspective illustration of the wiper blade assembly.

DETAILED DESCRIPTION

Referring now in more detail to the drawings, in which like numerals indicate like parts throughout the several views, FIG. 1 illustrates a portion of a gluer 10 which includes a glue supply pan 11, a glue wetting roll 12, a cylindrical glue applicator roll 14, a wiper blade assembly 15, pick finger support bar 16, a plurality of pick fingers 18, guide cams 19, and vacuum conveyor assembly 20. Supply platform 21 is located at an elevation lower than the cylindrical applicator roll 14 and is moved by cams up and down, toward and away from the suction fingers 22. The suction fingers 22 are mounted on a suction tube 24 which oscillates or rotates in timed relationship with the system to pick up the uppermost sheet 25 from the platform 21 and move the uppermost sheet between the feed rolls 26 and 28. Various guide plates and guide fingers (not shown) are used to help direct the leading edge of the sheet 25 to and beyond the feed rolls 26 and 28. The sheets are directed between the glue applicator roll 14 and presser roll 29. The roll 12 which is partially submerged in the liquid glue 30 in pan 11 rotates with a surface speed approximately equal to the surface speed of glue applicator roll 14 so as to wet the glue applicator roll with glue. When the sheet 25 passes in contact with the glue applicator roll 14, it becomes coated with the glue.

The plurality of pick fingers 18 each includes a curved lower edge 31 which is close juxtaposition with respect to the upper curved surface of the cylindrical glue applicator roll 14, and a pointed end 32 which faces the oncoming sheet material. As the sheet material moves past the line of contact between the presser roll 29 and glue applicator roll 14, the pointed ends 32 of each pick finger 18 tends to pick the leading edge of the sheet material away from the glue applicator roll 14, and the vertical edge 34 of each of the pick fingers tends to deflect the oncoming edge upwardly toward the guides 19, and the guides 19 further deflect the sheet material on toward the suction conveyor 20. The vertical edge 34 of each pick finger 18 as well as the contacting surfaces of the guides 19 are usually formed with a curvature that compliments the shape of the adjacent portion of the suction conveyor 20.

Suction conveyor 20 includes a conveyor belt 35 with a plurality of apertures 36 formed therein, and the belt moves in the direction indicated by arrow 38. A suction tray 39 is positioned immediately below the upper flight of the conveyor belt 35, and the inletof a blower (not shown) communicates with the tray 39 so as to induce a flow of air through the upper flight of the conveyor, through the openings 36. This tends to cause the sheets of material being fed through the system to cling to the upper flight of the belt conveyor as the upper flight moves in the direction indicated by arrow 38, away from the gluer 10.

As illustrated in FIG. 2, the wiper blade assembly 15 located at each end of the glue applicator roll 14 (only one wiper blade assembly blade being illustrated in FIG. 2) is mounted from the end bearing blocks 40 of the gluer. The wiper blade assembly (FIG. 3) includes horizontal support strap 41, vertical support strap 42, and wiper blade 44. The horizontal support strap 41 includes a slot 45 at one end and a pair of holes (not shown) at its other end. Screw 46 extends through the slot 45 and into an internally threaded bore (not shown) in the end bearing block 40 to hold the horizontal strap in position. The elongated slot 45 permits the wiper blade assembly 15 to be adjusted in various positions so as to properly locate the wiper blade 44 at the end of the glue applicator roll 14. Screws 48 extend through the opening at the other end of the horizontal support strap 41 and through a slot 49 at the upper end of the vertical support strap 42. The size of the slot 49 allows the support straps 41 and 42 to be adjusted with respect to each other.

Wiper blade 44 is rigidly connected to the lower end of vertical support strap 42. The vertical support strap 42 is bent intermediate its ends at 50 so that the wiper blade 44 is disposed at an angle beneath the cylindrical glue applicator roll 14.

Wiper blade 44 is fabricated from Delvin, Nylon, Teflon or other suitable, low-friction, long-lasting material. The blade 44 is connected by screws 51 extending through aligned openings in the blade and the lower end of the vertical strap 42. The blade 44 includes a substantially flat, vertical roll contact surface 52, a grooved portion 54 which includes a glue deflector surface 55, and a horizontal wiper leg 56. The wiper leg 56 includes a curved roll contact surfact 58 and a glue deflection surface 59 which is coextensive with the back of the wiper blade.

The wiper blade assemblies 41 are mounted at each end of the glue applicator roll 14, with the wiper blade assembly at the left end of the glue applicator roll (not shown) being a mirror image of the wiper blade assembly illustrated in the drawing. Each wiper blade assembly is mounted so that the flat vertical contact surface 52 of the wiper blade 44 is in abutment with the flat end surface of the cylindrical glue applicator roll 14. The bend 50 in the vertical strap 42 of the assembly permits the assembly to be supported from the end block 40, with the bend causing the vertical support strap 42 to have its lower portion reach around axle 60 of the glue applicator roll 14 and to locate the wiper blade 44 adjacent the lower portion of the roll 14.

When the equipment is in operation, the glue applicator roll 14 rotates in the direction indicated by arrow 61. The glue deflection surface 55 of the wiper blade 44 is angled back toward the axle 60, so that its edge 62 is located away from the periphery of the flat end of the roll 14 and therefore tends to be effective on a large area of the flat end of the roll 14 to wipe and accumulate and deflect the glue from the end of the roll. The angle formed by the glue deflection surface 55 extends between a tangent to the roll from the position of the horizontal leg 56 of the wiper blade and a radius from the axle 60 to the horizontal leg 56. As a result, the glue deflection surface 55 functions to divert the glue at an angle radially outwardly from the axle 60 off the flat end of the roll 14, so that the direction of rotation of the roll 14 assists in the removal of the glue from the end surface of the roll. In the meantime, the glue deflection surface 59 of the horizontal leg 56 of the wiper blade 44 tends to deflect the glue from the curved end portion of the roll 14, with the direction of rotation of the roll 14 also assisting in the wiping and deflection function.

Pick finger support bar 16 has an outside cylindrical surface along a major portion of its length, and its end portions 64 are rectangular in cross section. An internally threaded vertical opening 65 is formed therethrough, and an elevation screw 66 is threaded through the opening 65. The rectangular ends 64 of the pick finger support bar 16 are received in a rectilinear upward facing open end slot 68 formed in the upper portion of each bearing block 40 (only one shown). An internally threaded horizontal opening 69 is formed through the bearing block 40 and intersects the slot 68. An externally threaded screw 70 is threaded through the opening 69 and functions as a set screw. The facing surfaces of the slot 68 are substantially flat, and the corresponding surfaces of the rectangular end portion 64 of the pick finger support bar 16 are also substantially flat.

When the pick finger support bar 16 is mounted at its ends in the slots 68, the elevation screws 66 at each end of the bar will be rotated to properly position the bar 16 in an attitude that is approximately parallel to the glue applicator roll 14. The machine operator attempts to adjust the attitude of pick finger support bar 16 so that the pick fingers 18 will properly rest with their curved surfaces 31 in close juxtaposition with respect to the curved exterior surface of the glue applicator roll 14. When the proper adjustments are made by the operator by adjusting the elevation screws 66, the set screws 70 are tightened through their threaded openings 69 so that they are wedged against a vertical surface of the end portion 64 of the pick finger support bar, thereby forcing the other opposite flat surface of the end portion 64 into abutment with the facing flat surface of the slot 68 of the bearing block 40. The clamping forces between the facing flat surfaces of the end portions of the pick finger support bar and the slot 68 tend to maintain the pick finger support bar in its rectilinear configuration, and no bending or torsion forces are applied to the pick finger support bar.

While this invention has been described in detail with particular reference to a preferred embodiment thereof, it will be understood that variations and modifications can be effected within the spirit and scope of the invention as described hereinbefore and as defined in the appended claims.

I claim:

1. In apparatus for applying glue and the like to sheet-like material comprising a rotatable cylindrical roll including an annular surface and substantially flat end surfaces and mounted on an axle extending longitudinally therethrough, and means for applying liquid to said roll whereby sheet material contacts and is wetted by the roll, the improvement therein of a wiper blade assembly positioned at each end of said cylindrical roll with each wiper blade assembly comprising a support extending downwardly adjacent a flat end surface of said roll and extending on the side of said axle on which said roll moves through a downward arc, a wiper blade mounted on the lower end portion of said support and including a substantially flat contact surface in engagement with said flat end surface of said roll, a liquid deflection surface merging at an approximately right angle with said flat contact surface and extending at a deflection angle from in front of said axle and in a downward direction toward the lower portion of said roll, said wiper blade further including a wiper leg extending from adjacent the flat end surface of said roll about the portion of annular edge of said roll adjacent the flat end surface of said roll and including a wiper leg contact surface in engagement with the annular surface of said roll and a liquid deflection surface extending from the annular surface of said roll in a downward direction.

2. The improvement of claim 1 and wherein said wiper leg contact surface is concave and has a radius of curvature equal to the radius of curvature of the annular surface of said roll.

3. The combination of claim 1 and wherein said means for applying liquid to said cylindrical roll comprises a pan beneath said cylindrical roll of a length longer than the length of said cylindrical roll for containing liquid, and a lower wetting roll partially submerged in the liquid in said pan and in contact with said cylindrical roll.

4. The combination of claim 1 and further including a stationary rectilinear support bar positioned adjacent and parallel to said cylindrical roll, a plurality of pick fingers mounted on said support bar with each of said pick fingers including a concave surface normally in abutment with the annular surface of said cylindrical roll and a pointed portion merged with said concave surface for urging the sheets of material off said cylindrical roll, and mounting means at each end of said rectilinear support bar comprising a support block, an upwardly facing open ended slot formed in said support block for receiving an end of said support bar, vertical elevation means for supporting the end of said support bar at variable heights in said slot, and horizontally extending set screw means extending through said support block for rigidly holding the end of said support bar in said slot.

5. In apparatus for applying liquid glue and the like to sheets of material including a cylindrical applicator roll rotatable about a horizontal axis, means for applying liquid to the cylindrical applicator roll, and means for moving sheets of material into contact with said applicator roll, the improvement thereof a support block positioned at each end of said cylindrical applicator roll, a slot extending downwardly into each of said support blocks, a rectilinear support bar mounted at its ends in the slots of said support blocks and positioned above and oriented substantially parallel to said cylindrical applicator roll, a plurality of pick fingers mounted on said support bar and extending toward engagement with said cylindrical applicator roll, a vertical internally threaded opening extending through each end portion of said support bar in said slots, an externally threaded elevation screw threaded through the vertical openings at the ends of the support bar and engaging the slots of the end block and holding the end portions of said support bar at desired elevation in the slots for orienting the support bar with respect to said cylindrical applicator roll, and a horizontal internally threaded opening extending through each of said support blocks and intersecting the slot of each support block, and an externally threaded set screw threaded through the horizontal openings and engaging the ends of said support bar, whereby the support bar is rigidly held at its end portions in the slots of the support blocks.

* * * * *